US009051777B2

(12) United States Patent
Van Camp et al.

(10) Patent No.: US 9,051,777 B2
(45) **Date of Patent: *Jun. 9, 2015**

(54) DOOR SILL ASSEMBLIES WITH REPLACEABLE SILL DECKS

(71) Applicant: Endura Products, Inc., Colfax, NC (US)

(72) Inventors: Brent Van Camp, Kernersville, NC (US); Andrew Krochmal, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/050,421

(22) Filed: Oct. 10, 2013

(65) Prior Publication Data

US 2014/0318021 A1 Oct. 30, 2014

Related U.S. Application Data

(63) Continuation of application No. 13/367,875, filed on Feb. 7, 2012, now Pat. No. 8,567,128, which is a continuation-in-part of application No. 13/009,449, filed on Jan. 19, 2011, now Pat. No. 8,490,332.

(51) Int. Cl.

| | |
|---|---|
| ***E06B 1/70*** | (2006.01) |
| ***E06B 7/23*** | (2006.01) |
| *E06B 3/96* | (2006.01) |

(52) U.S. Cl.

CPC ..... *E06B 1/70* (2013.01); *E06B 3/9632* (2013.01); *E06B 2001/707* (2013.01); *E06B 7/2314* (2013.01)

(58) Field of Classification Search

CPC ..... E06B 1/70; E06B 7/2314; E06B 3/9632; E06B 2001/707

USPC ..... 49/467, 468, 469, 470, 471; 52/211

See application file for complete search history.

(56) References Cited

U.S. PATENT DOCUMENTS

| | | | | |
|---|---|---|---|---|
| 1,910,260 | A | | 5/1933 | Reher |
| 2,089,380 | A | | 8/1937 | Krammerer |
| 2,848,766 | A | * | 8/1958 | Fulton ..... 49/469 |
| 3,032,837 | A | | 5/1962 | Ramsey |
| 3,032,839 | A | | 5/1962 | Miller |
| 3,402,512 | A | | 9/1968 | Peterson |

(Continued)

OTHER PUBLICATIONS

Application as filed (U.S. Appl. No. 10/683,312, filed Oct. 10, 2003); Final Office Action, mailed Jan. 11, 2008; Notice of Abandonment, mailed Jul. 25, 2008, pp. 1-30.

(Continued)

*Primary Examiner* — Katherine Mitchell
*Assistant Examiner* — Justin Rephann
(74) *Attorney, Agent, or Firm* — Womble Carlyle Sandridge & Rice, LLP

(57) ABSTRACT

A door sill assembly for an entryway of a building can include a substrate having a sill channel. A sill deck can be on the substrate. The sill deck can include a deck and a clip. In an embodiment, the sill deck and clip are a unitary construction. The clip can be operably engaged with the deck. The clip can be removably attachable to the substrate. The sill deck is capable of removable attachment from the door sill assembly before or after the door sill assembly is installed in the entryway without removal or damage to any portion of the side jambs.

16 Claims, 18 Drawing Sheets

(56) References Cited

U.S. PATENT DOCUMENTS

| | | | | |
|---|---|---|---|---|
| 3,521,404 | A | 7/1970 | Hager et al. | |
| 3,762,100 | A | 10/1973 | Kempel | |
| 3,774,343 | A | 11/1973 | Cribben et al. | |
| 3,962,828 | A | 6/1976 | McAllister | |
| 4,055,917 | A | 11/1977 | Coller | |
| 4,079,550 | A | 3/1978 | Bursk et al. | |
| 4,156,325 | A | 5/1979 | McMullen et al. | |
| 4,222,200 | A | 9/1980 | Beimes, Jr. | |
| 4,224,766 | A | 9/1980 | Procton | |
| 4,237,664 | A | 12/1980 | Silmes | |
| 4,287,684 | A | 9/1981 | McKann | |
| 4,310,991 | A | 1/1982 | Seely | |
| 4,352,258 | A | 10/1982 | Bursk et al. | |
| 4,399,636 | A | 8/1983 | Blackwell | |
| 4,411,104 | A | 10/1983 | Aubin | |
| 4,447,987 | A | 5/1984 | Lesosky | |
| 4,473,981 | A | 10/1984 | Simpson | |
| 4,513,536 | A | 4/1985 | Giguere | |
| 4,578,905 | A | 4/1986 | Hout | |
| 4,631,866 | A | 12/1986 | Otto et al. | |
| 4,831,779 | A * | 5/1989 | Kehrli et al. | 49/471 |
| 4,945,680 | A | 8/1990 | Giguere | |
| 4,956,952 | A | 9/1990 | Bancroft | |
| 5,012,614 | A | 5/1991 | Shea | |
| 5,136,814 | A | 8/1992 | Headrick | |
| 5,230,181 | A | 7/1993 | Geoffrey et al. | |
| 5,283,977 | A | 2/1994 | Smith | |
| D354,572 | S | 1/1995 | Headrick | |
| 5,426,894 | A | 6/1995 | Headrick | |
| 5,517,788 | A | 5/1996 | McGough et al. | |
| 5,524,391 | A | 6/1996 | Joffe et al. | |
| 5,588,266 | A | 12/1996 | Headrick | |
| 5,611,173 | A | 3/1997 | Headrick et al. | |
| 5,638,641 | A * | 6/1997 | Joffe et al. | 49/469 |
| 5,673,517 | A | 10/1997 | Stanclift | |
| 5,943,825 | A | 8/1999 | Procton et al. | |
| 6,006,375 | A | 12/1999 | Carr | |
| 6,044,600 | A | 4/2000 | McCollough | |
| 6,052,949 | A | 4/2000 | Procton et al. | |
| 6,138,413 | A | 10/2000 | Fehr | |
| 6,185,870 | B1 | 2/2001 | Mettler | |
| 6,216,395 | B1 | 4/2001 | Kelly | |
| 6,269,591 | B1 | 8/2001 | Kelly | |
| 6,289,635 | B1 | 9/2001 | Procton et al. | |
| 6,367,201 | B1 | 4/2002 | Massey et al. | |
| 6,371,188 | B1 | 4/2002 | Baczuk et al. | |
| 6,484,446 | B2 | 11/2002 | Young | |
| 6,625,941 | B2 | 9/2003 | Shaw | |
| 6,763,639 | B2 | 7/2004 | Bennett et al. | |
| 6,789,358 | B2 | 9/2004 | Procton et al. | |
| 6,829,864 | B2 | 12/2004 | Mitchell et al. | |
| 7,111,433 | B2 | 9/2006 | Kerscher | |
| 7,263,808 | B2 | 9/2007 | Massey et al. | |
| 7,266,929 | B1 | 9/2007 | Allred et al. | |
| 7,350,336 | B2 | 4/2008 | Bennett | |
| 7,389,611 | B2 | 6/2008 | Palenske | |
| 7,472,516 | B2 | 1/2009 | Pepper et al. | |
| 7,536,833 | B2 | 5/2009 | Baczuk et al. | |
| 7,600,346 | B2 | 10/2009 | Meeks | |
| 7,694,471 | B2 | 4/2010 | Meeks et al. | |
| 7,775,011 | B2 | 8/2010 | Baczuk et al. | |
| 7,788,863 | B2 | 9/2010 | Pepper et al. | |
| D638,143 | S | 5/2011 | Procton et al. | |
| 8,061,086 | B2 | 11/2011 | Haun | |
| 8,413,383 | B2 | 4/2013 | Van Camp et al. | |
| 8,490,332 | B2 | 7/2013 | Van Camp et al. | |
| 2002/0129557 | A1 * | 9/2002 | Young | 49/468 |
| 2002/0194787 | A1 | 12/2002 | Bennett | |
| 2003/0126826 | A1 * | 7/2003 | Marshall et al. | 52/718.01 |
| 2004/0128925 | A1 | 7/2004 | Massey | |
| 2004/0139667 | A1 | 7/2004 | Massey et al. | |
| 2004/0200152 | A1 | 10/2004 | Khanlarian | |
| 2004/0200153 | A1 | 10/2004 | Khanlarian | |
| 2005/0210754 | A1 | 9/2005 | Ferrell | |
| 2006/0053695 | A1 | 3/2006 | Palenske | |
| 2006/0096190 | A1 | 5/2006 | Baczuk et al. | |
| 2006/0112644 | A1 | 6/2006 | Pepper et al. | |
| 2006/0174545 | A1 | 8/2006 | Young | |
| 2006/0225364 | A1 | 10/2006 | Chen | |
| 2008/0120914 | A1 * | 5/2008 | Fink et al. | 49/469 |
| 2008/0172957 | A1 | 7/2008 | Kerscher | |
| 2008/0229669 | A1 | 9/2008 | Abdollahzadeh | |
| 2012/0047808 | A1 * | 3/2012 | Davidson | 49/381 |
| 2013/0047518 | A1 | 2/2013 | Van Camp et al. | |

OTHER PUBLICATIONS

Application as filed (U.S. Appl. No. 11/241,753, filed Sep. 30, 2005); Final Office Action, mailed Dec. 14, 2009; Notice of Abandonment, mailed Jun. 24, 2010, pp. 1-44.

Official Action for U.S. Appl. No. 13/367,875, dated May 9, 2013, 9 pgs.

Official Action for Canadian Serial No. 2,753,768, dated Feb. 14, 2013, 3 pgs.

Official Action of U.S. Appl. No. 13/009,449, dated Aug. 1, 2012, 13 pgs.

Official Action for U.S. Appl. No. 13/009,449, dated Feb. 4, 2013, 10 pgs.

* cited by examiner

DOOR SILL ASSEMBLIES WITH REPLACEABLE SILL DECKS

CROSS-REFERENCE TO RELATED APPLICATIONS

This application is a continuation of U.S. patent application Ser. No. 13/367,875, filed on Feb. 7, 2012; which is a continuation-in-part of U.S. patent application Ser. No. 13/009,449, filed on Jan. 19, 2011, now U.S. Pat. No. 8,490,332, the entirety of which is incorporated by reference herein.

FIELD OF THE INVENTION

The present invention relates generally to entry door sill constructions, and more particularly, to a door sill construction having a replaceable sill deck.

BACKGROUND OF THE INVENTION

Door sills can be damaged during shipment from the manufacturer to the construction site, or more commonly during construction of a building. Common causes include objects dropped on the sill, excessive traffic within a relatively short time period, or accidental application of paint or stucco to the door sill. Left unrepaired, the door sill will not function as originally designed, i.e., the damaged door sill will not provide an effective seal between the frame and door, nor will the door sill manage water intrusion that minimizes moisture accumulation. Unrepaired door sills do not have the desirable aesthetics that newly manufactured and installed door sills have.

There are solutions available to a building owner or contractor who installs the door systems. The damaged door sill can be completely cut out and replaced. While a new door sill may be aesthetically pleasing, this particular type of repair can damage the surrounding mullions, doorjambs, astragals or other structures, compromising the entire stability or function of the entryway system. Replacing a door sill is also costly, and is rarely done. An alternative is to simply attach a metal cover patch to the exposed surface of the existing door sill. The metal patch is not aesthetically or functionally equivalent to the original, undamaged door sill. This repair can also be costly because it is cut and notched on-site in order to provide the proper fit to the door unit.

There is a need, therefore, for a door sill system that retains functionality, allows for easy replacement of door sill components, and can address any damage arising during shipping, installation, or construction.

SUMMARY OF THE INVENTION

The following presents a simplified summary of the invention in order to provide a basic understanding of some aspects of the invention. This summary is not an extensive overview of the invention and is not intended to identify key or critical elements of the invention or to delineate the scope of the invention. The purpose of this section is to present some concepts of the invention in a simplified form as a prelude to the more detailed description that is presented later.

A door sill assembly for an entryway of a building can include a substrate having a nosing and a sill channel. A nosing cover can be attached to the substrate and extending over at least a portion of the nosing and over at least a portion of the sill channel. A sill deck can be on the substrate. The sill deck can include a deck and a clip. In selected embodiments, the sill deck and clip can be formed as a unitary construction.

The deck can be engaged with a portion of the nosing cover. The clip can be operably engaged with the deck. The clip can be removably attachable to the substrate. The sill deck is capable of removable attachment from the door sill assembly before or after the door sill assembly is installed in the entryway.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

Figure 1:
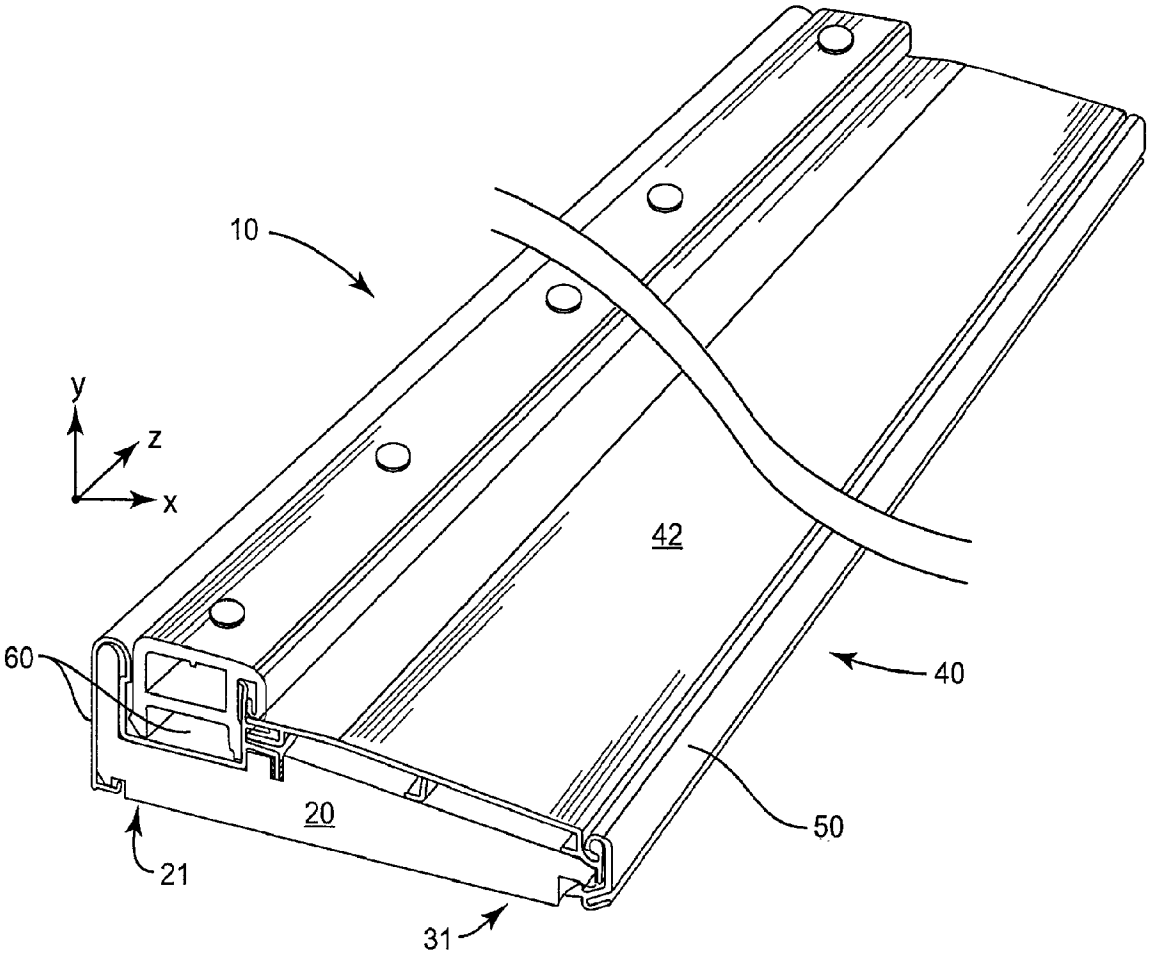
FIG. 1 is a front perspective view of a door sill assembly with a replaceable sill deck thereon according to an embodiment of the invention.

FIGS. 1 through 3B show door sill assemblies 10 and 11, and temporary protective covers 90 and 95, according to embodiments of the invention. As shown in FIGS. 1 and 2A, the door sill assembly 10 includes a substrate 20 having an upwardly extending nosing 22 and substrate dam 24 defining a sill channel 23. The assembly 10 also includes a nosing cover 60 on the substrate 20, a sill cap 80 received by the sill channel 23, and a removable sill deck 40 engaged with the nosing cover 60 and substrate 20. The sill deck 40 includes a deck 42 connected to a clip 50. The clip 50 is on the substrate 20, and can pivot to allow removal of sill deck 40 from the door sill assembly 10 before or after installation of the door assembly in the building.

A conventional, e.g., 4⁹⁄₁₆ inch width, door sill assembly is shown in FIGS. 1 through 3B that can be used with single in-swing doors typical of entryways in residential homes. The door sill assembly, however, may have any particular width as the need may arise. FIGS. 4 through 9B show embodiments of a 5⅝ inch wide door sill assembly with a replaceable sill deck and temporary protective covers. The embodiments shown in FIGS. 4 through 9B can also be used with single in-swing doors. In other embodiments, the door sill assemblies as described herein may be used with double in-swing doors, sliding door constructions, or outswing doors. FIGS. 10A through 11D show yet another embodiment of the invention wherein the door sill assembly comprises one or more mullions and one or more sidelight panels.

Figure 2A:
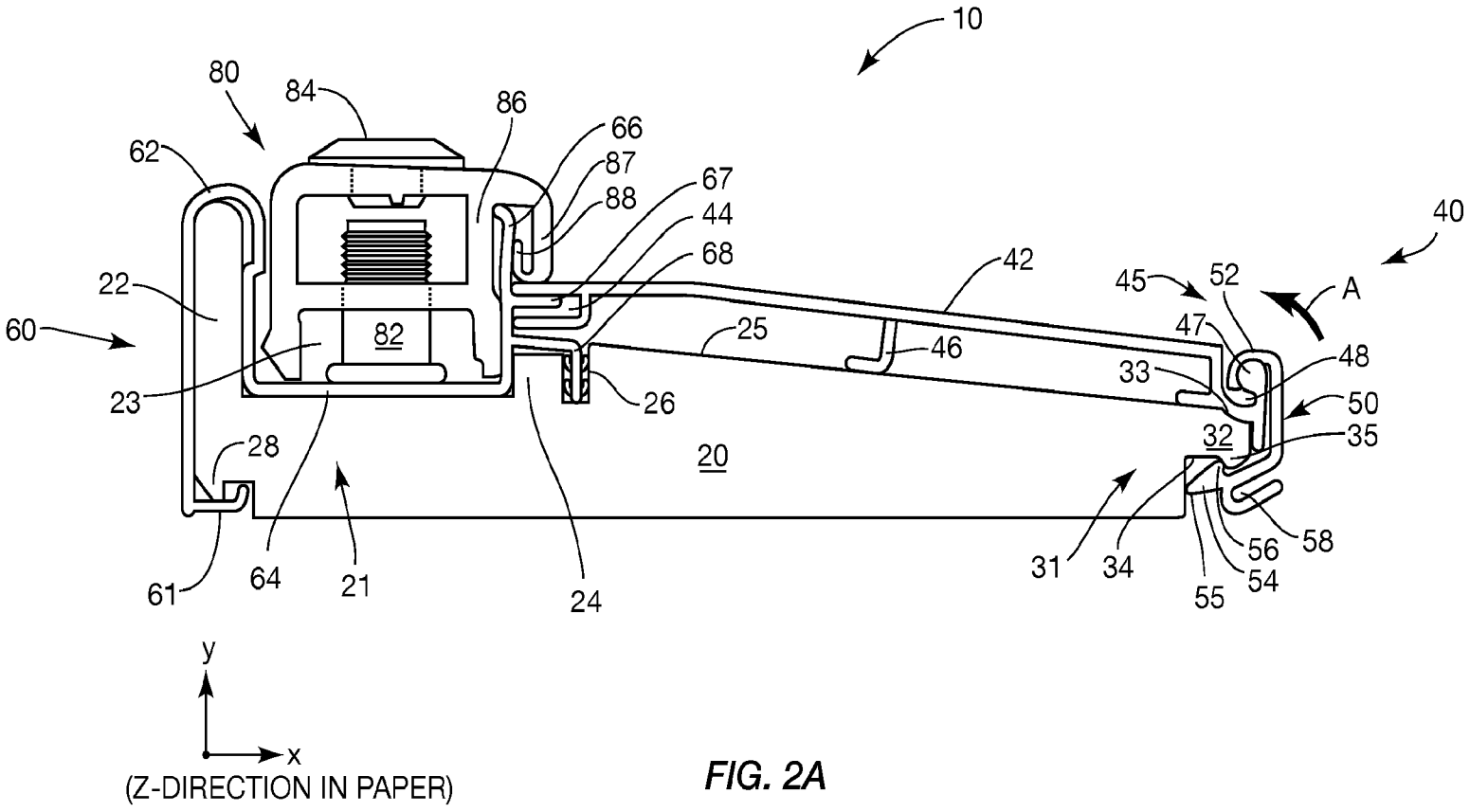
FIG. 2A is a side view of a door sill assembly with a replaceable sill deck thereon according to an embodiment of the invention.

FIG. 2A shows how the substrate 20 can engage the nosing cover 60 and sill deck 40. The substrate 20 has a first end 21 near the inside of the building, the first end 21 including the nosing 22 and sill channel 23. A nosing lip 28 is located at the underside of the nosing 22 near the undersurface of the substrate 20. The nosing lip 28 receives a portion of the nosing cover 60, as will be further discussed below. The substrate second end 31 is opposite the first end 21 and can include a ledge 32 configured to receive the clip 50. In particular, the ledge 32 can have upper and lower surfaces 33 and 34, respectively, and a lip 35 to engage the clip 50.

The substrate 20 can be any material, including, but not limited to, wood, composite, polymeric or other rigid material. Additional fillers can be included in the substrates as needed, e.g., wood flour and/or materials other than the primary material. In one embodiment, the substrate can be integrally formed. For example, the substrate can be integrally formed as described in U.S. Pat. No. 6,789,358, the entirety of which is herein incorporated by reference. In another embodiment, the substrate can be integrally formed for the entirety of its length. In yet another embodiment, several substrate sections of the substrate can abut one another or connect together to form the support structure for the door sill.

As shown in FIG. 2A, the nosing cover 60 includes lower portion 61, nosing portion 62 covering the upper surface of the nosing 22, sill channel portion 64, and a dam portion 66 having first and second projections 67 and 68. The nosing cover lower portion 61 engages the nosing lip 28 on the undersides of the substrate 20 to secure the nosing cover 60 to the first end 21 of the substrate 20. The nosing portion 62 extends over the nosing 22 and turns down toward the substrate 20 to cover at least a portion of the surface of the sill channel 23 forming the sill channel portion 64. In the embodiment shown, sill channel portion 64 covers all of the surface of the sill channel 23.

The dam portion 66 can extend upwardly from the sill channel portion 64. In an embodiment, the dam portion 66 is adjacent to, and can extend vertically past the top of the substrate dam 24. First and second projections 67 and 68 respectively can extend over the substrate dam 24 and engage the deck 42 and the substrate 20, respectively. More specifically, the first projection 67 can be received by a deck channel 44, and the second projection 68 can be received within an opening 26 on the substrate 20. The second projection 68 is shown with multiple sealing fins that help form a water and vapor seal when second projection 68 is placed in the opening 26. In another embodiment, the first projection 67 can have sealing fins also. The first projection 67 and second projection 68 can extend from dam portion 66 along the length (along the Z-axis as shown in FIG. 1) of the nosing cover 60. In alternate embodiments, however, the first and second projections 67 and 68 can be formed by several spaced-apart segments. Although two projections 67 and 68 are shown in FIG. 2, more or less than two projections can be used to engage with the sill deck 40 and substrate 20.

In alternate embodiments, the nosing cover 60 can include a nosing portion 62 and sill channel portion 64 in the sill channel 23, but not extend to or cover the dam portion 66. The nosing cover, nosing portion and sill channel portion 64 can extend the length of the sill.

Continuing with FIGS. 1 and 2A, the nosing cover 60 can extend down the length (Z-direction) of the door sill assembly. So configured, the nosing cover 60 helps form a water and vapor barrier and can help limit water seeping into the substrate 20. The nosing cover 60 allows water to drain into and seep through drain channels (not shown) at opposing sides of the door sill. Further, if one or more substrate portions are combined to form the substrate, the nosing cover 60 spans across the seams formed between adjacent substrate segments. Having a barrier over such seams can also help limit water intrusion.

Figure 2B:
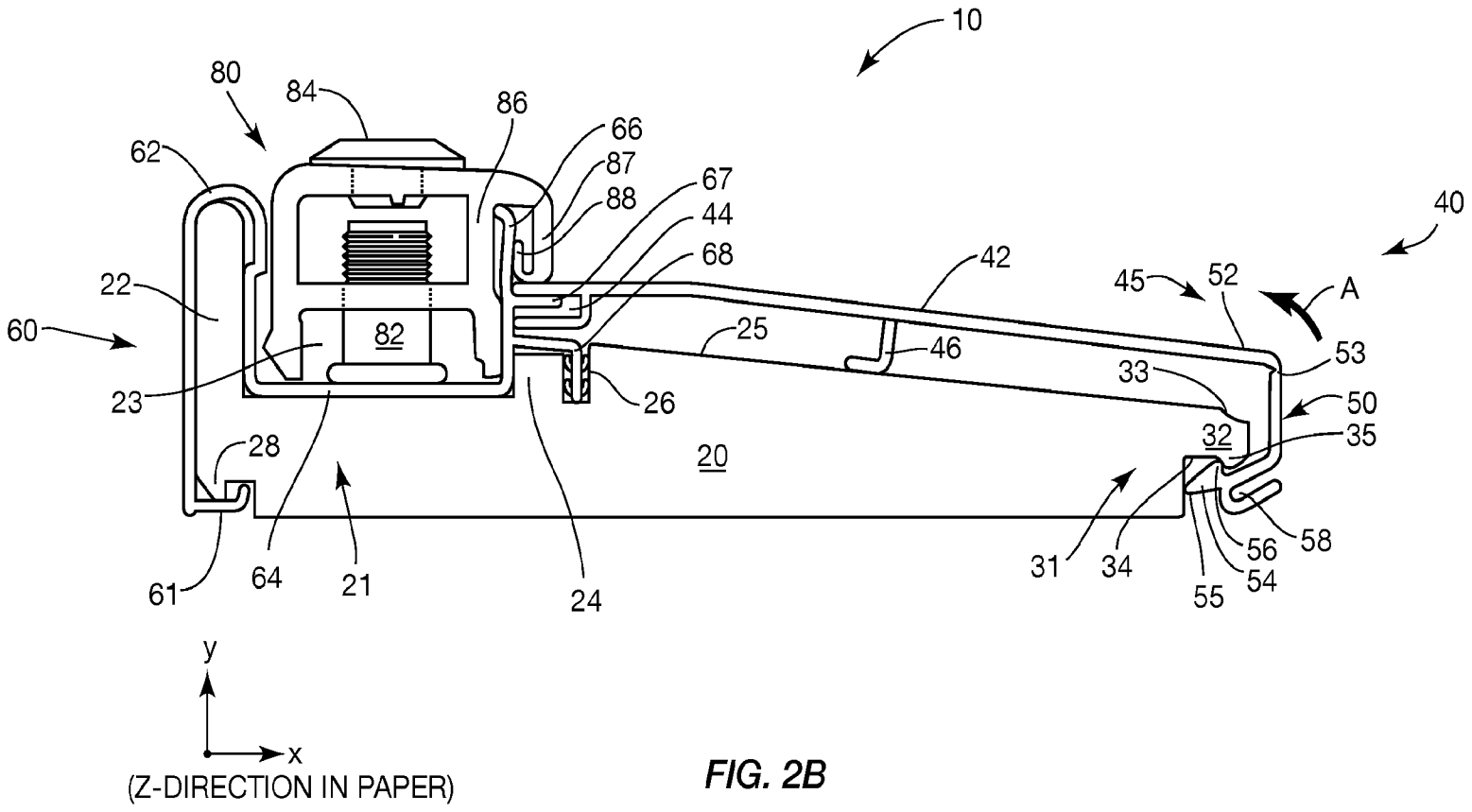
FIG. 2B is a cut-away side view of the door sill assembly of FIG. 2 illustrating an alternative embodiment having an integrally-formed sill deck and clip.
Figure 3A:
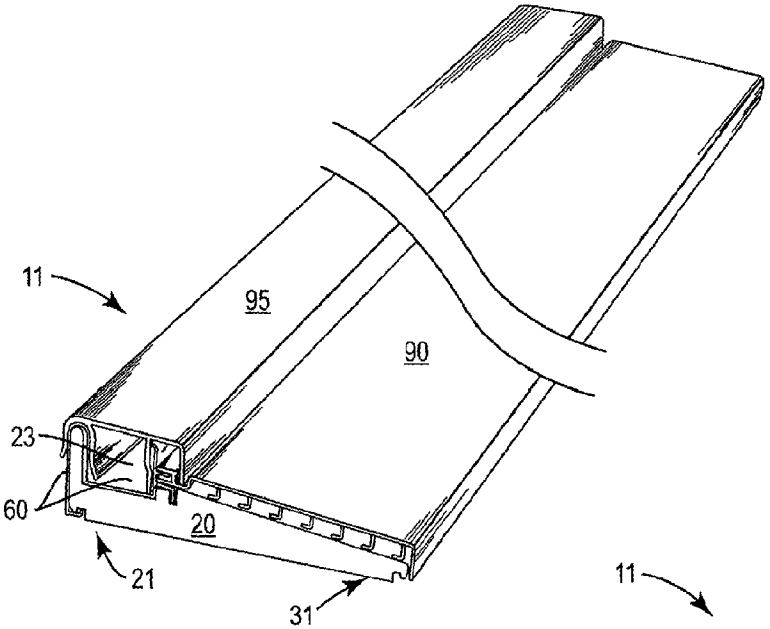
FIGS. 3A and 3B show front perspective and side views, respectively, of optional protective covers on a door sill assembly shown in FIGS. 1 and 2.
Figure 3B:
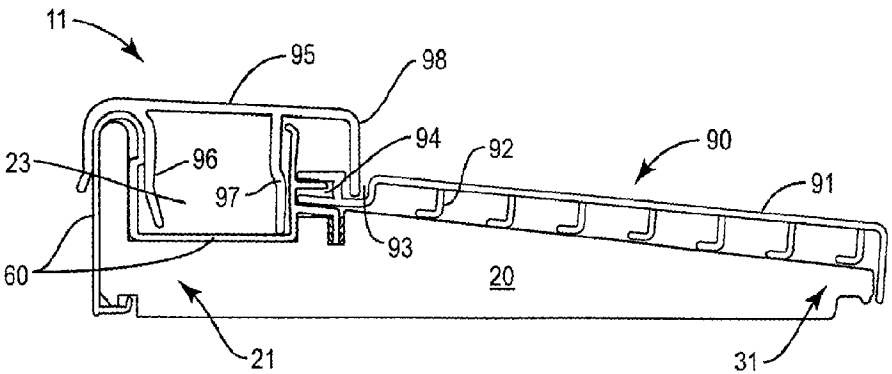

FIGS. 2A and 2B show an adjustable sill cap 80 disposed in the sill channel 23 and on the nosing cover 60. The sill cap 80 includes an adjustable element 82 in the body 86, cap plug 84 and a leg 87. The leg 87 extends in the Y-direction and then down toward the sill deck 40. A flexible fin 88 on the distal end of leg 87 can contact the nosing cover dam portion 66 and deck 42 to form a seal. The seal can be an additional barrier to water intruding through the door sill assembly 10. In another embodiment for outswing type doors, the sill cap can have a leg extending in the Y-direction down toward the deck, and contain a bulb at the distal end of the leg to form a seal with the dam or the deck.

An installer, resident, or homeowner can remove cap plug 84 from the sill cap 80 and access the adjustment element 82. The adjustment element 82 can be rotated to cause adjustment of the sill cap 80 between a raised position (not shown) elevated above the substrate 20 and a lowered position as shown in FIGS. 2A and 2B. In other embodiments, non-adjustable sill caps can be used.

As stated, the sill deck 40 includes a deck 42 and a clip 50, the clip 50 being pivotally connected to the deck 42 in a preferred embodiment. The deck 42 and clip 50 together form the tread portion of door sill assembly 10. The deck 42 and clip 50 typically are formed of aluminum, or other material that is durable for use in an entryway.

As shown in FIGS. 2A and 2B, the deck 42 can include a channel 44, support leg 46, and a clip engaging end 45. The channel 44 receives the first projection 67 extending from the nosing cover 60. The support leg 46 can extend from the undersurface of the deck 42 to rest atop the substrate 20. One or more support legs can be used to support the deck 42, as needed. As shown in FIG. 2A, the clip engaging end 45 can include a knuckle joint 47 and a curvilinear slot 48 that engages the clip 50. The slot 48 can receive a curved clip leg 52 that is slidable in the Z direction therein.

The sill deck 40 removal is accomplished by taking advantage of the design of the deck 42 and clip 50. As shown in FIG. 2A, the clip 50 has a clip end 54 configured to engage a lip 35 on the undersurface on substrate ledge 32. More specifically, the clip end 54 can have a first engagement point 55, and a second engagement point 56 that releasably extends over the lip 35. The clip engaging end 45, resting on ledge upper surface 33, and the clip engagement points 55 and 56 engage with the second end 31 of the substrate 20 to limit vertical (Y-direction) and horizontal (X-direction) displacement of the clip 50. Because the clip 50 is also connected to the deck 42 at the knuckle joint 47, the deck 42 is pressed into engagement with the projection 67 of the nosing cover 60, vertical and horizontal displacement of the sill deck 40 is minimized. To facilitate removal, a slot 58 can be positioned proximate to the clip end 54 and can be designed to receive a tool, e.g., a screw driver, flat edged tool or the like. A user inserts the tool into the slot 58 and by pivoting the tool to force the clip end 54 from beneath the substrate ledge 32 so that the clip leg 52 pivots about the knuckle joint 47. In this manner, the clip 50 is pivoted about the deck 42 in the direction of arrow A as shown.

As shown in the cut-away view of FIG. 2B, in another embodiment, the deck 42 and clip 50 may be formed as a unitary piece, with the clip engaging the substrate second end 31 in similar fashion as the embodiment of FIG. 2A. As shown, at the end of the deck 42, where the deck 42 intersects with the clip 50, a score line, groove, or weakened area of decreased thickness 53 can be formed. Constructed in this manner, a user inserts the tool into the slot 58 and can force the clip end 54 from beneath the substrate ledge 32 so that the front edge of the sill deck 42 flexes or breaks along the score line 53, allowing the clip leg 52 to pivotally disengage in the direction of the arrow A as shown.

Under either of the embodiments shown in FIG. 2A or 2B, once the clip 50 is removed from the substrate 20, the deck 42 can be disengaged from the projection 67 by sliding the deck 42 in the X-direction, thereby allowing the entire sill deck 40 to be completely removed from the door sill assembly 10 and frame structure. Sill deck 40 removal occurs without modification or damage to the frame structure, and without disassembly of the remaining portions of the door sill 10. A new sill deck with a deck and clip can then be removeably attached onto the substrate 20 by reversing the above steps, thereby preserving the originally designed functionality and aesthetics of the installed door sill.

The scope of this invention also includes the use of optional temporary protective covers, which can later be removed and discarded, and replaced with a sill deck upon completion of the construction. Temporary protective covers can be placed on door sill assembly 10 during door assembly manufacture, or during installation of the door sill assembly in the building. The temporary protective covers allow a pre-hung door to be assembled and shipped to the job site without the final sill deck and sill cap assembly attached, thus minimizing damage risk to these door sill components. In the embodiment shown in FIGS. 3A and 3B, a door sill assembly 11 can include a temporary deck protective cover 90 and temporary sill cap protective cover 95. The temporary deck protective cover 90 includes a deck surface 91 and a plurality of supports 92 extending therefrom to rest on the substrate 20. A channel 94 receives one of the projections extending from the nosing cover 60. The protective sill cap cover 95 can be placed over the nosing cover 60 to protect the sill channel 23. The sill cap protective cover 95 includes a first leg 96 and a second leg 97 that can provide support and contact the nosing 22 and sill channel 23. An extension leg 98 engages a channel 93 in the deck surface 91, securing the deck protective cover 90 in place. The temporary protective covers 90 and 95 can be removed once construction of the building is complete and discarded as waste. A replaceable sill deck as described above can then be installed.

Figure 4:
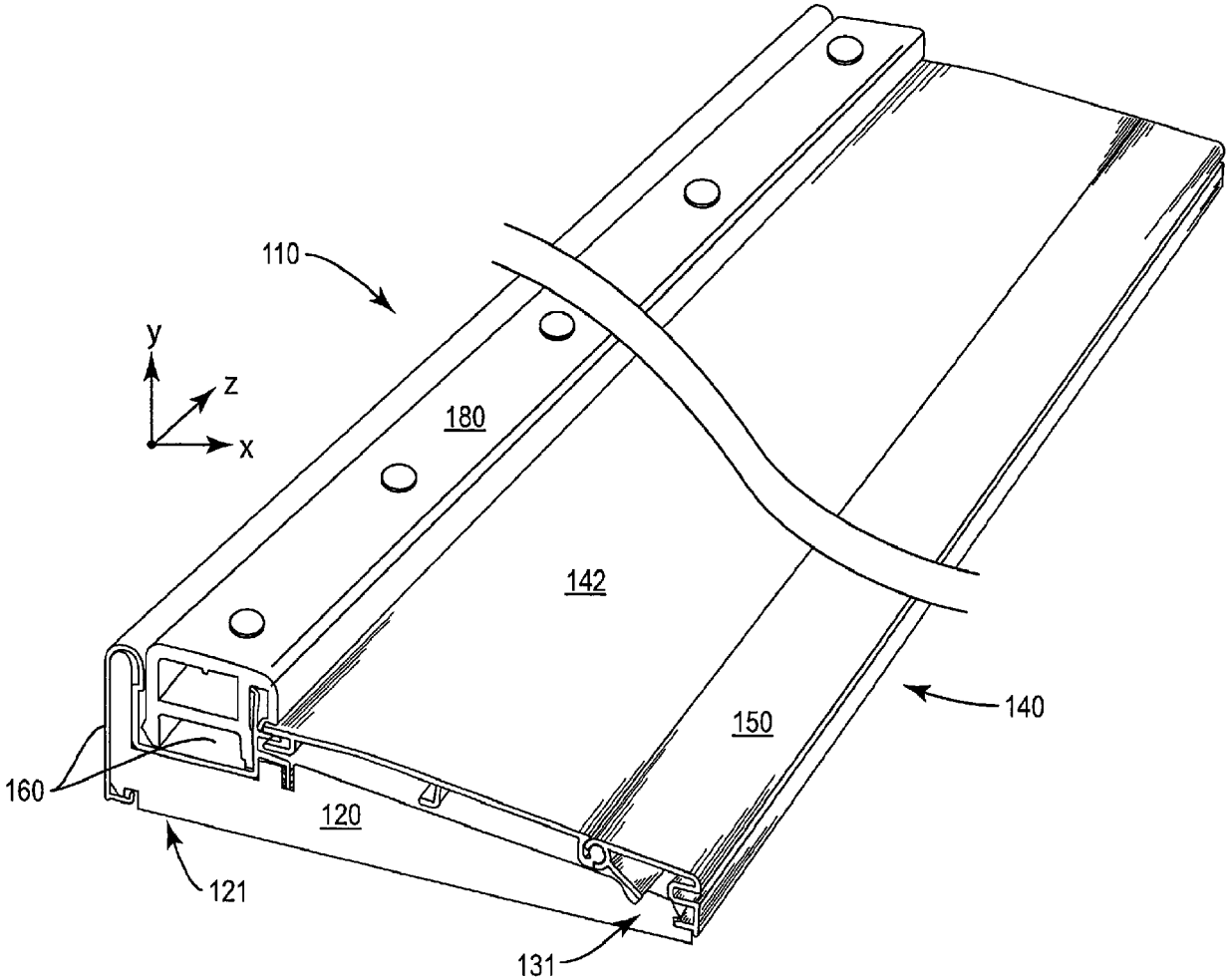
FIG. 4 is a front perspective view of a door sill assembly with a replaceable sill deck thereon according to an embodiment of the invention.
Figure 5:
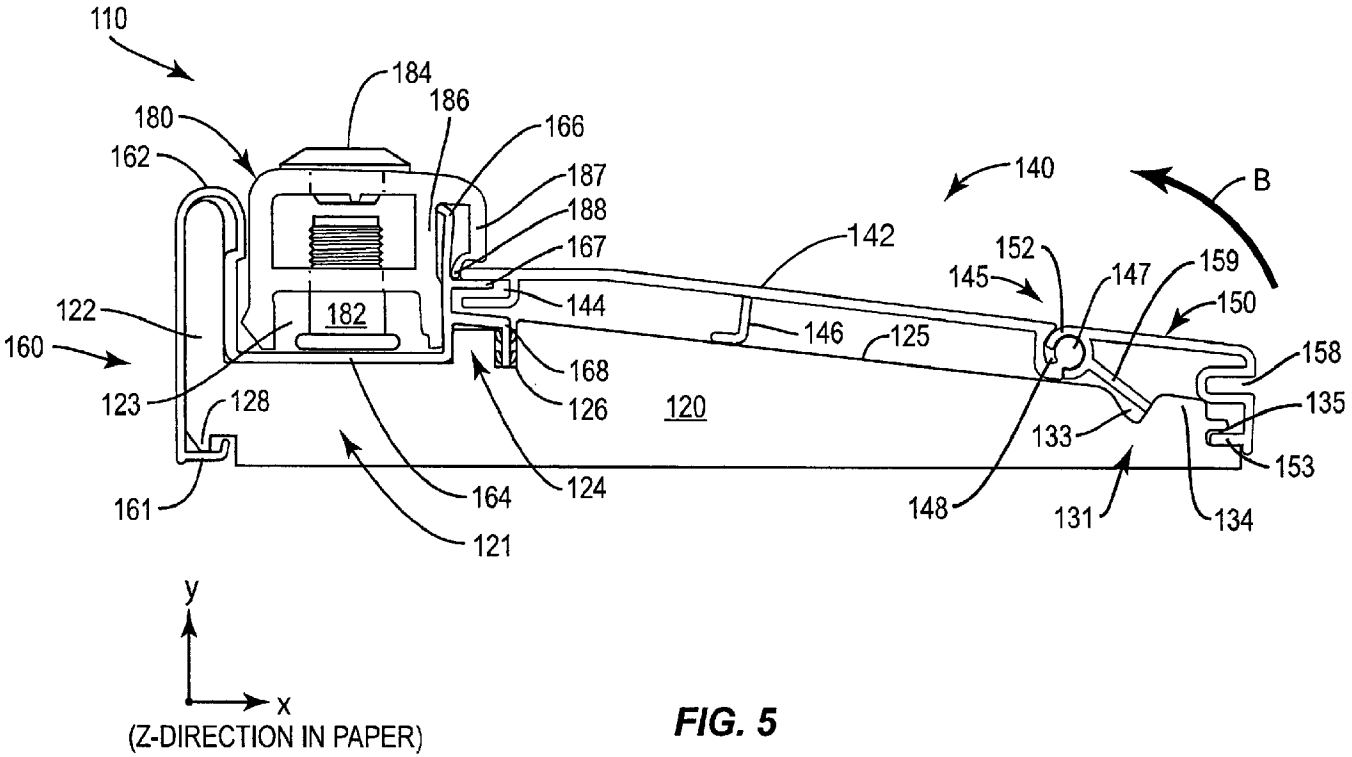
FIG. 5 is a side view of a door sill assembly with a replaceable sill deck thereon according to an embodiment of the invention.

FIGS. 4 through 6B show another door sill assembly, according to another embodiment. While the embodiment shown can be used with doors of various widths, in one embodiment the door sill assembly is a 5⅝ inch wide door sill. As shown in FIGS. 4 and 5, the door sill assembly 110 includes a substrate 120, nosing 122 and substrate dam 124. Also shown is a sill channel 123, nosing cover 160, sill cap 180 in the channel 123, and a replaceable sill deck 140. The nosing cover 160, sill channel 123, sill cap 180, and the first end 121 of the substrate 120 are constructed and function similar to the equivalent components of the embodiment described above and shown in FIGS. 1 and 2A, 2B. As shown best in FIG. 5, however, the second (or outside-facing) end 131 of the substrate 120 includes an indentation 133 near the ridge 134, and a slot 135 positioned at the end 131 of the substrate 120. The indentation 133 can receive a first clip leg 159 while the slot 135 receives a second clip leg 153. Details of the clip 150 are discussed below.

As shown in FIGS. 4 and 5, the sill deck 140 includes a deck 142 and an interconnected clip 150. The deck 142 can include a channel 144 for engaging the nosing cover 160, at least one support leg 146, and a clip engaging end 145 shown in this embodiment as pivotally connecting to the clip 150. The channel 144 receives a first projection 167 extending from the nosing cover 160. The support leg 146 extends from the undersurface of the deck 142 to rest atop the substrate 120. One or more support legs can be used to support the deck 142, as needed. The clip engaging end 145 includes a knuckle joint 147 and a curved slot 148 that receives a portion of the clip 150. The lower surface of the clip engaging end 145 can rest on the upper surface 125 of the substrate 120.

As shown in FIG. 5, the clip 150 includes a curved clip leg 152, first and second clip legs 159 and 153, and a slot 158 for receiving a tool. The curved clip leg 152 slidably (in the Z-direction) fits within the slot 148, connecting the clip 150 to the deck 42. The first clip leg 159 extends from the knuckle joint 147 into the indentation 133, while the second leg 153 is received in the substrate slot 135. The clip legs 153 and 159 when engaged with the second end 131 of the substrate 120 limit vertical (Y-direction) and horizontal (X-direction) displacement of the clip 150. Because the clip 150 is also connected to the deck 142 at the knuckle joint 147, the deck 142 is pressed into engagement with the projection 167 of the nosing cover 160, vertical and horizontal displacement of the sill deck 140 is minimized. A tool can be inserted into the slot 158 and pivoted to release the clip leg 153 out of the slot 135. The clip 150 can pivot in the direction of arrow B to disengage from the substrate 120 and nosing cover 160. This allows the sill deck 140 to be completely removable from the door sill assembly 110 without cutting, modifying, or damaging the surrounding frame structure of the door sill assembly, or disassembling the door sill. A new sill deck can be placed on the substrate and nosing cover as needed.

Figure 6A:
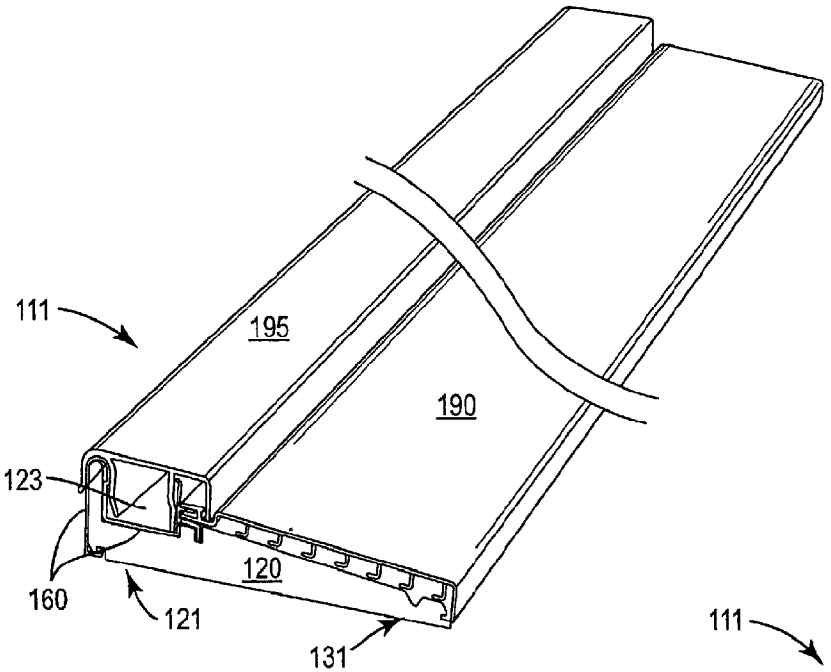
FIGS. 6A and 6B show front perspective and side views, respectively, of optional protective covers on the door sill assembly shown in FIGS. 4 and 5.
Figure 6B:
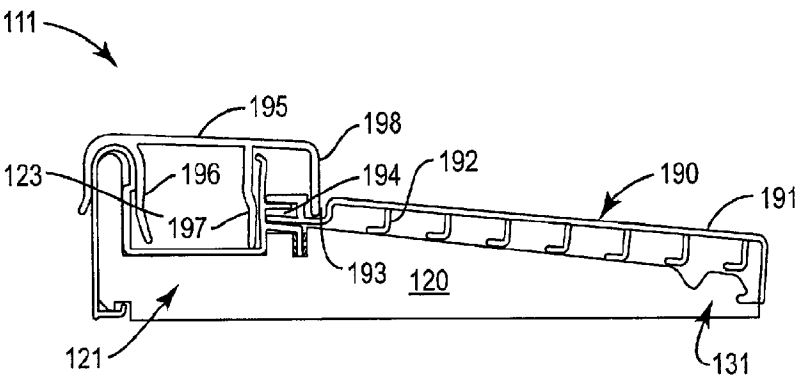

FIGS. 6A and 6B show a door sill assembly 211 with optional temporary protective covers that fit the substrate described in FIGS. 4 and 5 above. The covers 190 and 195 function similarly to the protective covers described above and shown in FIGS. 3A and 3B. The deck protective cover 190 includes a deck surface 191 and a plurality of supports 192 extending therefrom to rest on the substrate 120. A channel 194 receives one of the projections extending from the nosing cover 160. The temporary protective sill cap cover 195 can be placed over the nosing cover 160 to protect the sill channel 123. The sill cap protective cover 195 includes a first leg 196 and a second leg 197 that can be placed upon the nosing 122 and sill channel 123. An extension leg 198 engages a channel 193 in the deck surface 191, securing the deck protective cover 190 in place. In an embodiment, the temporary covers 190 and 195 can be installed on door sill assembly 111 and shipped to the construction site. The door sill assembly 111 can be installed in the building entryway. The protective covers 190 and 195 can be removed once construction of the building is complete and discarded. A replaceable sill deck as described above can be installed.

Figure 7:
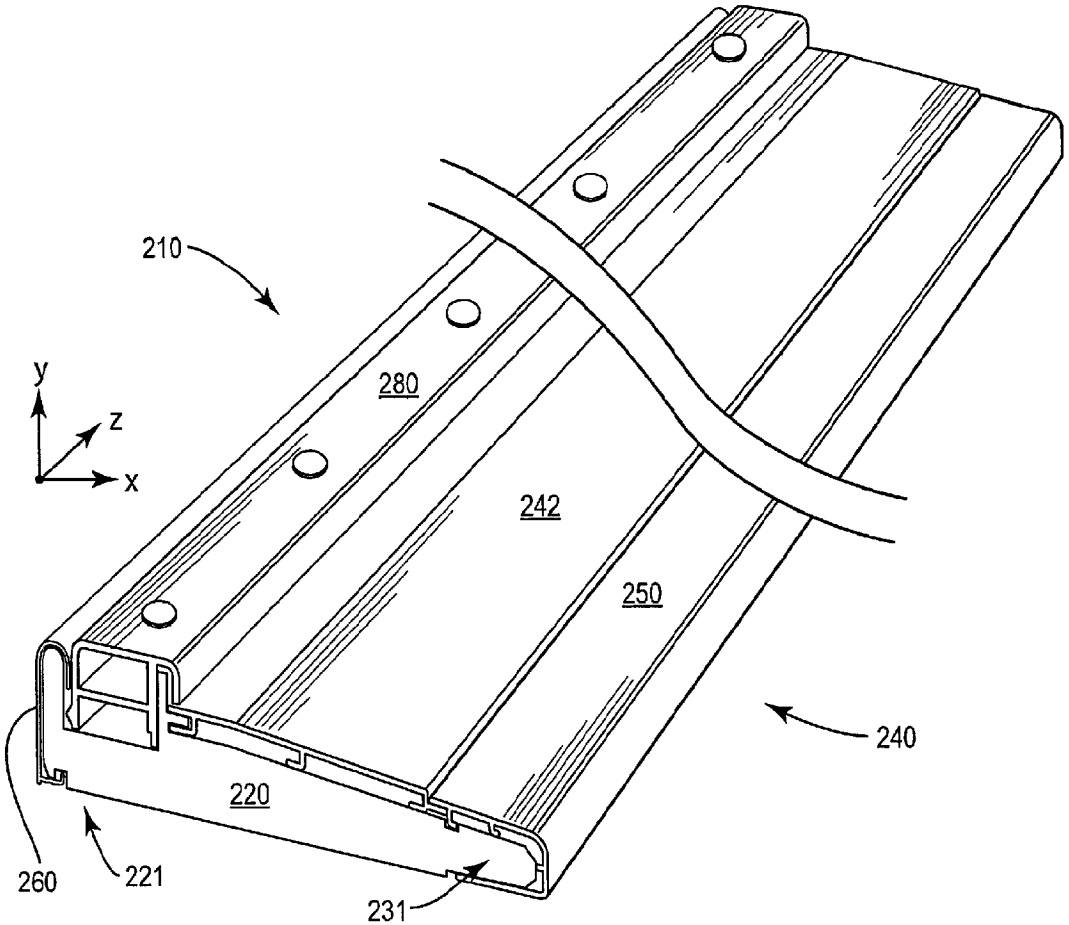
FIG. 7 is a front perspective view of a door sill assembly with a replaceable sill deck thereon according to an embodiment of the invention.
Figure 8:
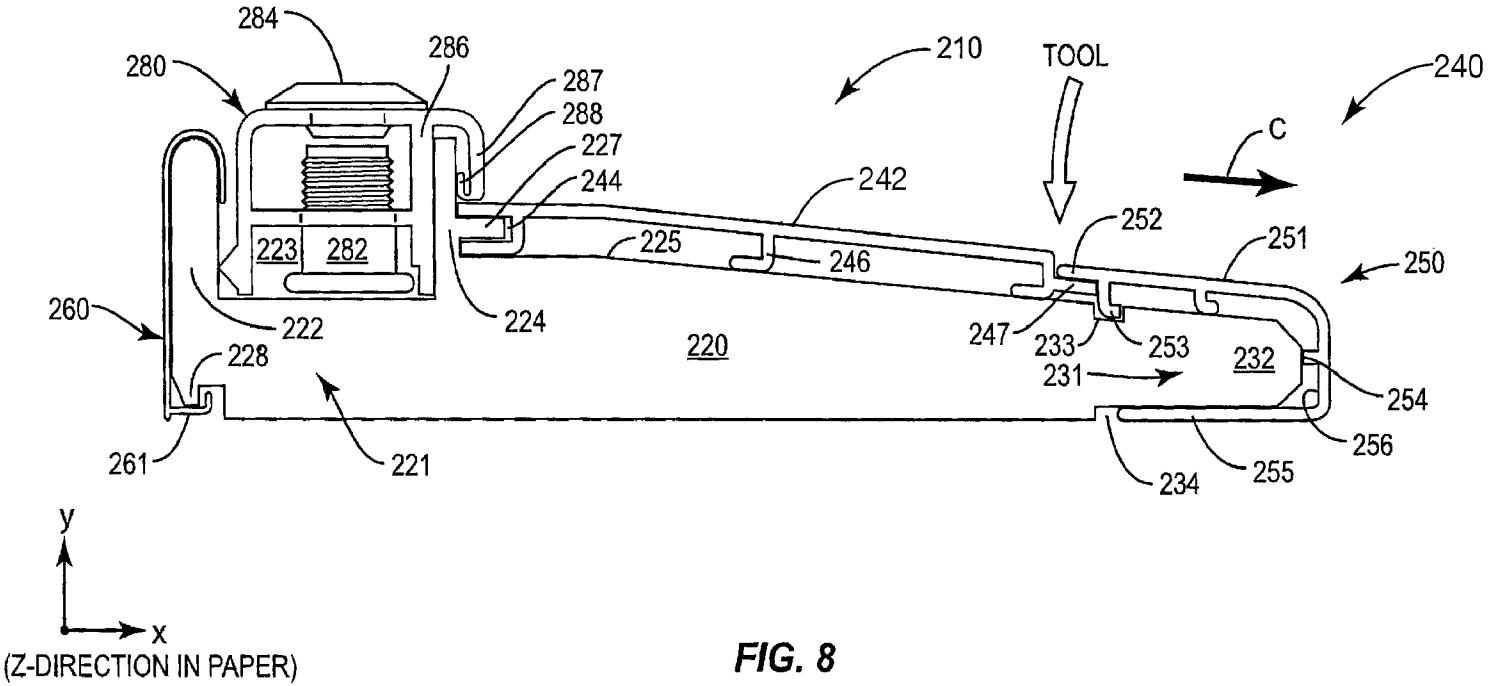
FIG. 8 is a side view of a door sill assembly with a replaceable sill deck thereon according to an embodiment of the invention.

FIGS. 7 through 9B show a door sill assembly 210 according to another embodiment of the invention. Turning to FIGS. 7 and 8, the door sill assembly 210 includes a substrate 220 having an upwardly extending nosing 222 and dam 224, a nosing cover 260 attached to the substrate 220, and a sill cap 280 in the sill channel 223.

FIG. 8 shows how the substrate 220 engages the nosing cover 260 and sill deck 240. The substrate 220 includes a first end (or inside facing end) 221, and an opposite second end 231. The first end 221 includes an upwardly extending nosing 222 and a dam 224 forming a sill channel 223 therebetween that is sized to receive the sill cap 280 as shown. A projection 227 extends in the X-direction from the dam 224 to receive the deck 242. While one projection is shown, one or more projections can be used. Further, other configurations could be employed for securing the deck 242 to the substrate 220, preferably in the X- and Y-directions.

The second end 231 of the substrate 220 includes a ledge 232, an indentation 233, and an undersurface 234 that represents in this embodiment a cutaway or relief in this portion of the substrate 220. The ledge 232 is configured to receive a clip 250, as described below.

The substrate 220 shown in FIG. 8 can be integrally formed to include the nosing, dam, and projections. Further, the substrate 220 can be formed similarly to the substrates as described in the embodiments above and shown in FIGS. 1 through 6B.

As shown in FIGS. 7 and 8, the nosing cover 260 includes a lower ledge 261 secured to a lower lip 228 of the substrate 220. The nosing cover 260 extends just over the top of nosing 222 and extending but not reaching the bottom of the sill channel 223. In other embodiments, however, a nosing cover 260 can include a nosing portion, sill channel cover portion, and an upwardly extending dam, as described above and shown in FIGS. 2 and 5.

FIGS. 7 and 8 show an adjustable sill cap 280 disposed on the sill channel 223. The sill cap 280 includes a body 286 having an adjustment element 282 disposed thereon and resting atop substrate 220. A leg 287 extends downwardly toward the sill deck 250 from the body 286 and spaced therefrom to receive the dam 224. The sill cap 280 function similar to embodiments described above. For outswing doors, however, the sill cap leg 287 can include a bulb (not shown) at its distal end to seal with deck 242. Further, other features typical of outswing sill caps can be used with replaceable sill decks and nosing covers as described herein.

As shown in FIGS. 7 and 8, the sill deck 240 includes a deck 242 and clip 250. The deck 242 engages both the substrate 220 and clip 250, while the clip 250 engages the second end 231 of the substrate 220. The deck 242 includes a channel 244, a support leg 246, and a deck platform 247 for positioning with the clip 250. The channel 244 is sized to receive the projection 227 extending from the dam 224. A support leg 246 extends from the deck 242 and rests atop the substrate 220 to support the deck 242. More than one support leg can be used as needed.

As best shown in FIG. 8, the clip 250 has a top 252, bottom 255, and inner surface 256 that fits around the substrate ledge 232. A plurality of legs 253 and 254 extended from the inner surface 256 to removeably engage the substrate ledge 232. The first leg 253, as described above, is received within the indentation 233. The second leg 254 extends inwardly in the X-direction to contact the distal end of the substrate ledge 232. The top 252 rests upon a deck platform 247 and the bottom 255 is received on the undersurface 234 of the ledge 232.

When the clip 250 engages the deck 242, the clip top 252 rests on the deck platform 247. The legs 253 and 254 limit horizontal (X-direction) displacement of the clip 250 about the substrate 220 while the top 252 and bottom 255 limit vertical (Y-direction) displacement of the clip 250 about the substrate. Because vertical and horizontal displacement of the clip 250 is minimized, the deck 240 is pressed into engagement with the dam projection 227, vertical and horizontal displacement of the sill deck 240 about the door sill assembly 210 is minimized.

A tool can be used to separate the clip 250 from the deck 242 and substrate 220. A tool can be inserted (see arrow marked TOOL) proximate the clip top 252 and pivoted to move the clip top 252 away from the deck ledge 247. This movement will raise the leg 253 out of the indentation 233. This can then allow the clip 250 to slide in the X-direction of arrow C away from the deck 242. With the clip 250 removed from the substrate 220, the deck 242 can be removed from engagement with the dam projection 227 by moving the deck 242 in the same X-direction of arrow C. A new sill deck including a new deck and clip can be replaced on the door sill assembly by reversing these steps.

Figure 9A:
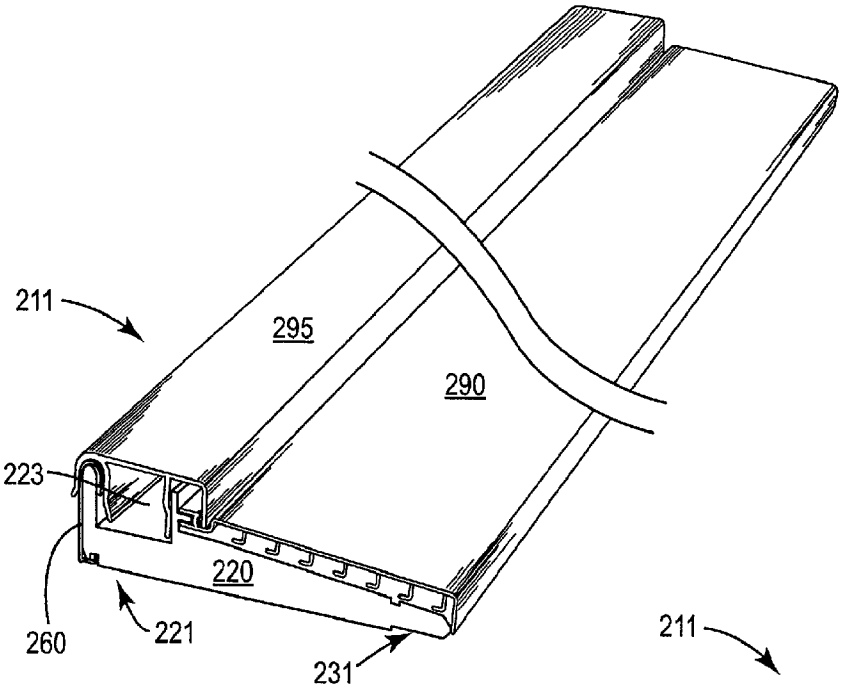
FIGS. 9A and 9B show front perspective and side views, respectively, of optional protective covers on the door sill assembly shown in FIGS. 7 and 8.
Figure 9B:
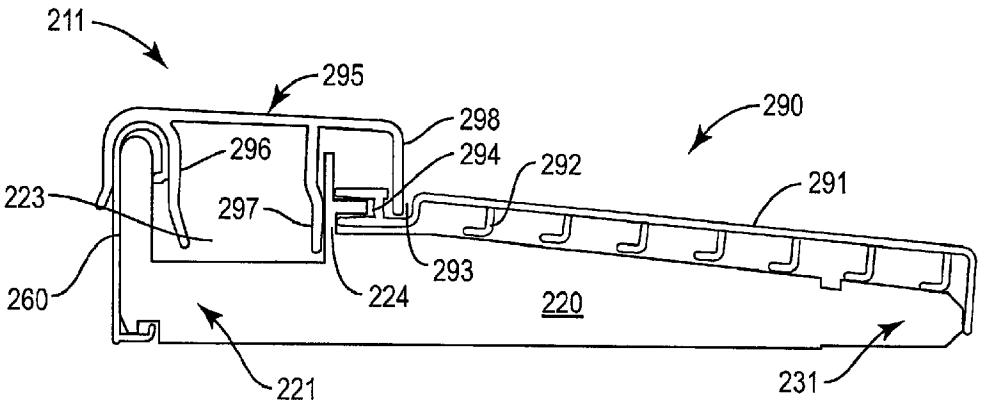

FIGS. 9A and 9B show a door sill assembly 211 with optional temporary protective sill deck covers, suitable for use with the substrate 220 described above. A deck protective cover 290 includes a deck surface 291 and a plurality of supports 292 extending therefrom to rest on the substrate 220. A channel 294 receives one of the projections extending from the dam 224. A protective sill cap cover 295 can be placed over the nosing cover 260 to protect the sill channel 223. The sill cap protective cover 295 includes a first leg 296 and a second leg 297 that can contact the nosing 222 and sill channel 223. An extension leg 298 engages a channel 293 in the deck surface 291, securing the deck protective cover 290 in place. The protective covers 290 and 295 can be removed once construction of building is complete and the replaceable sill deck as described above can be installed.

Figure 10:
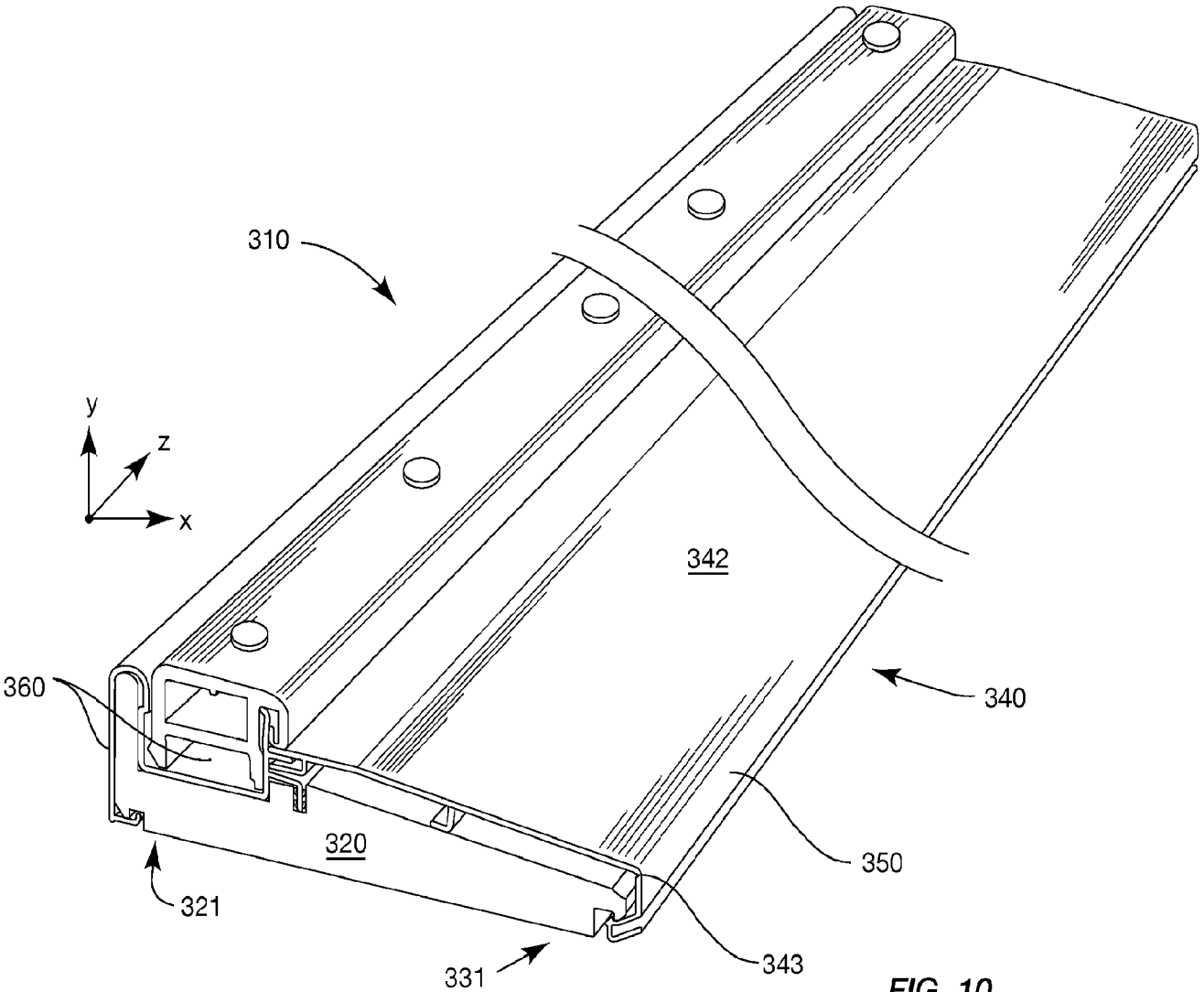
FIG. 10 is a front perspective view of a door sill assembly with a replaceable sill deck thereon according to an embodiment of the invention.
Figure 11:
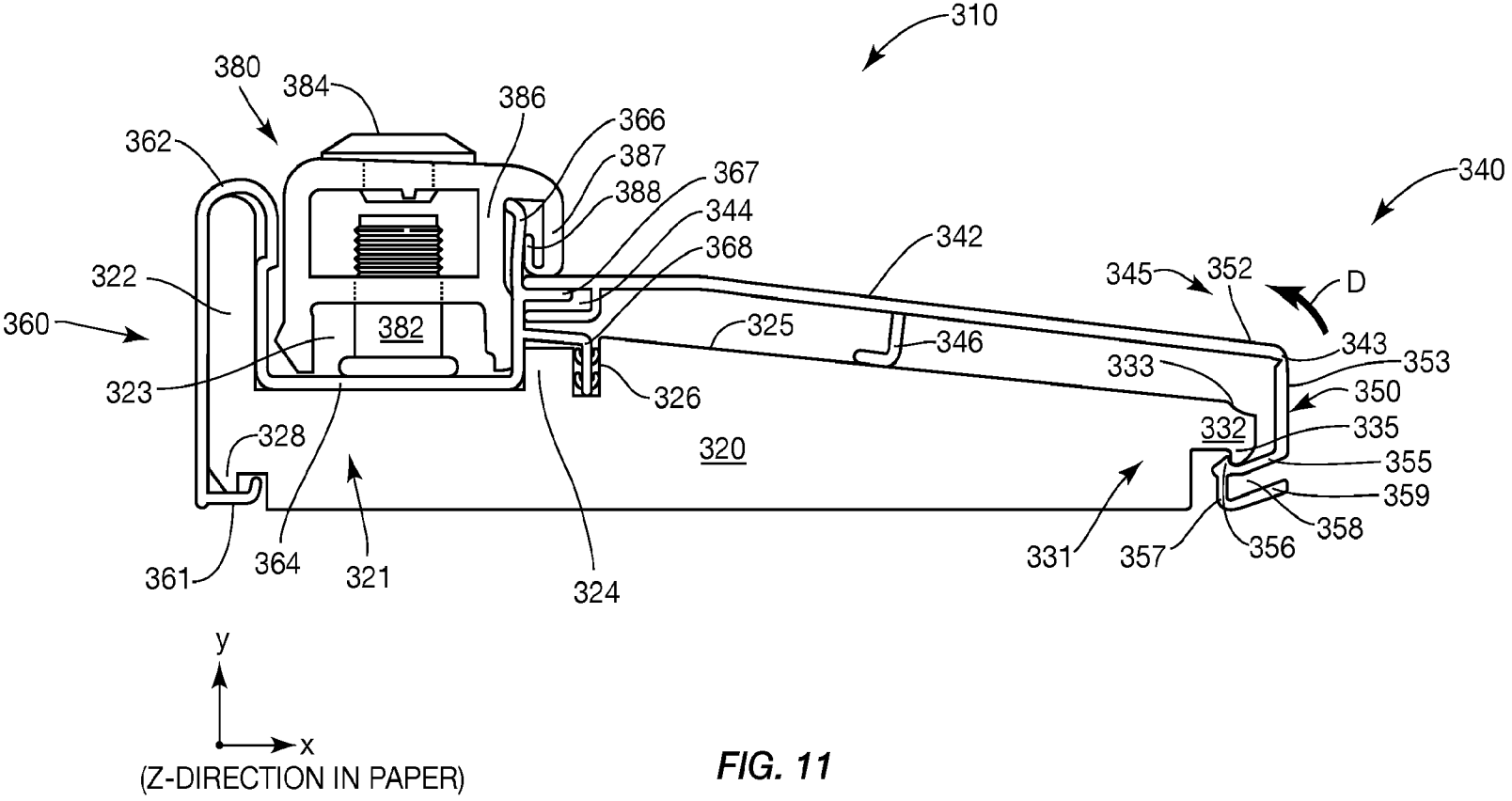
FIG. 11 is a side view of a door sill assembly with a replaceable sill deck thereon according to an embodiment of the invention.

FIGS. 10 through 12B show another door sill assembly, according to another embodiment. While the embodiment shown can be used with doors of various widths, in one embodiment the door sill assembly is a 5⅝ inch wide door sill. As shown in FIGS. 10 and 11, the door sill assembly 310 includes a substrate 320, nosing 322 and substrate dam 324. Also shown is a sill channel 323, nosing cover 360, sill cap 380 in the channel 323, and a replaceable sill deck 340. The nosing cover 360, sill channel 323, sill cap 380, and the first end 321 of the substrate 320 are constructed and function similar to the equivalent components of the embodiment described above and shown in FIGS. 1 and 2A. As shown best in FIG. 11, the second (or outside-facing) end 331 of the substrate 320 includes a ledge 332, including a lip 335 for engaging a clip 350, as discussed in detail below.

As shown in FIGS. 10 and 11, the sill deck 340 includes a deck 342 and clip 350. The deck 342 includes a channel 344 for engaging the nosing cover 360, at least one support leg 346, and a clip engaging end 345. The channel 344 receives a first projection 367 extending from the nosing covet 360. The support leg 346 extends from the undersurface of the deck 342 to rest atop the substrate 320. One or more support legs can be used to support the deck 342, as needed.

As shown in FIG. 11, the clip 350 is integrally formed with and connected to the deck 342 at the end 352 of the deck 342. A first clip leg 353 extends substantially vertically downwardly. As explained in greater detail below, located at the intersection between the deck 342 and the clip 350 is a score line, groove, or weakened area 343. In the embodiment shown in FIG. 11, the score line 343 is V-shaped. A second clip leg 355 extends inwardly and at a slight downward angle from the bottom edge of the first clip leg 353. A third clip leg 357 extends downwardly substantially vertically downwardly from the edge of second clip leg 355. Lastly, a fourth clip leg 359 extends outwardly from the edge of the third clip leg 357, and substantially parallel with the second clip leg 355, forming a slot 358 for receiving a tool. Extending upwardly and slightly inwardly from the top of the third clip leg 357 is a projection 356 for engaging the lip 335 on the outermost surface of ledge 332. When the deck 342 is slidably installed (by sliding inwardly in the negative X-direction) on the substrate 320, the second clip leg 355 will resistantly bow slightly to allow the projection 356 to snap over lip 335. The clip is so formed that the second clip leg 355 will be caused to flex slightly downwardly. As the deck 342 is fully seated, the second clip leg 355 will return to its normal position and the projection 356 will engage the lip 335 on the outermost surface of channel 332. When the deck 342 is fully seated, the second clip leg 355 and the projection 356 limit vertical (Y-direction) and horizontal (X-direction) displacement of the clip 350. A tool can be inserted into the slot 358 and pivoted in the direction of arrow D, which will cause the second clip leg 355 to flex downwardly, disengaging the projection 356. Continued pivotal movement of the tool in the direction of arrow D will cause the first clip leg 353 to pivot about the weakened area of the score line 343, wherein the clip is completely disengaged. If desired, continued pivotal movement can cause the clip 350 to break at the score line 343, separating the clip 350 from the deck 342. In either case, this allows the deck 340 to be completely removable from the door sill assembly 310 without cutting, modifying, or damaging the surrounding frame structure or door jambs of the door sill assembly, or disassembling the door sill. A new sill deck can be placed on the substrate and nosing cover as needed.

Figure 12A:
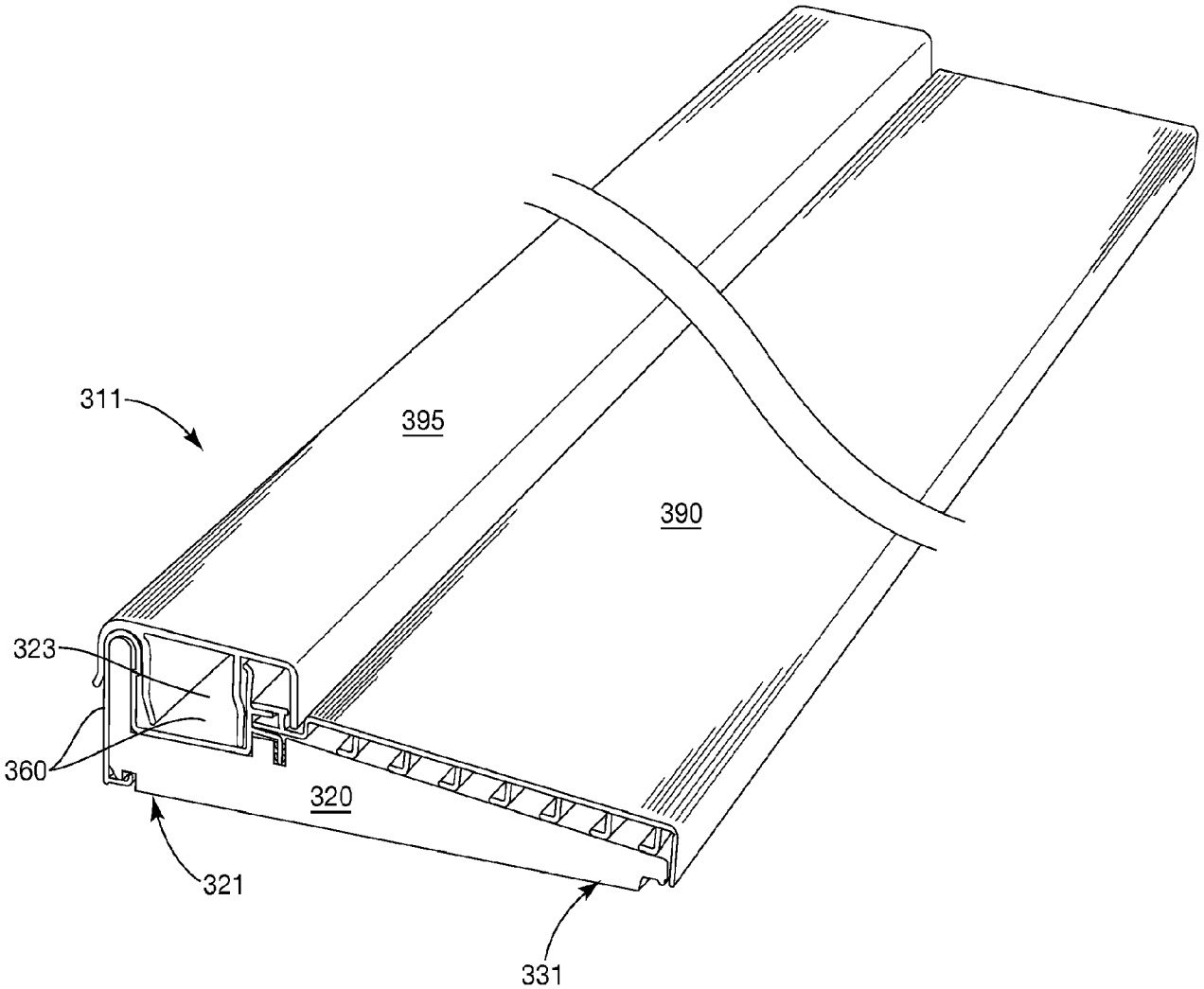
FIGS. 12A and 12B show front perspective and side views, respectively, of optional protective covers on the door sill assembly shown in FIGS. 10 and 11.
Figure 12B:
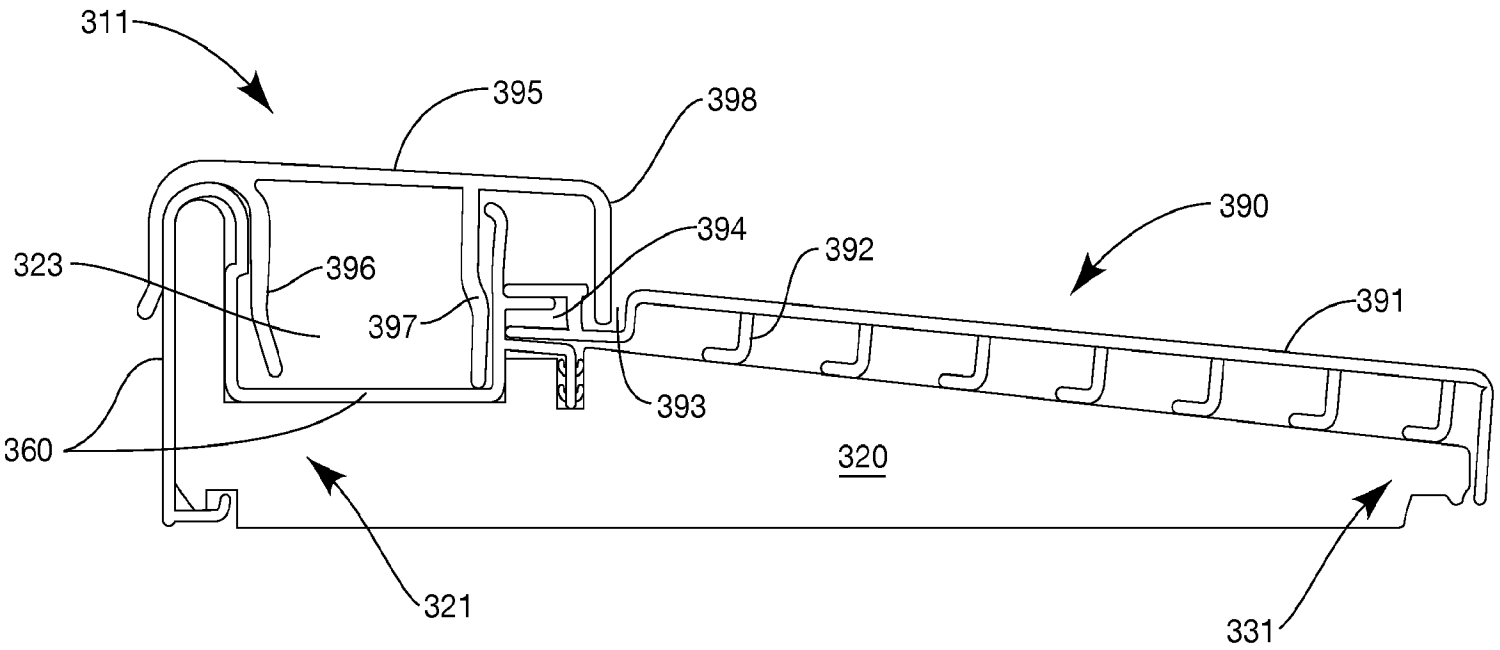

FIGS. 12A and 12B show a door sill assembly 311 with optional temporary protective covers that fit the substrate described in FIGS. 10 and 11 above. The covers 390 and 395 function similarly to the protective covers described above and shown in FIGS. 3A and 3B. The deck protective covet 390 includes a deck surface 391 and a plurality of supports 392 extending therefrom to rest on the substrate 320. A channel 394 receives one of the projections extending from the nosing cover 360. The temporary protective sill cap cover 395 can be placed over the nosing cover 360 to protect the sill channel 323. The sill cap protective cover 395 includes a first leg 396 and a second leg 397 that can be placed upon the nosing 322 and sill channel 323. An extension leg 398 engages a channel 393 in the deck surface 391, securing the deck protective cover 390 in place. In an embodiment, the temporary covers 390 and 395 can be installed on door sill assembly 311 and shipped to the construction site. The door sill assembly 311 can be installed in the building entryway. The protective covers 390 and 395 can be removed once construction of the building is complete and discarded. A replaceable sill deck as described above then can be installed.

Figure 13A:
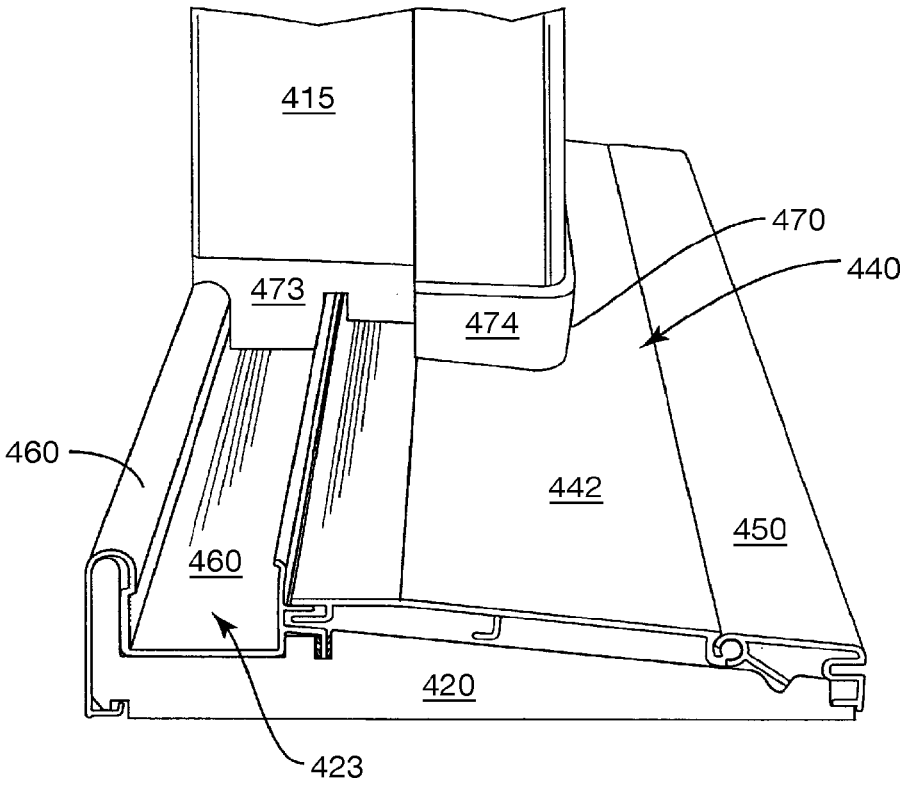
FIGS. 13A and 13B show side perspective and front perspective assembly views, respectively, of a door sill assembly installed in an entryway having a mull and a sidelight panel according to another embodiment of the invention.
Figure 13C:
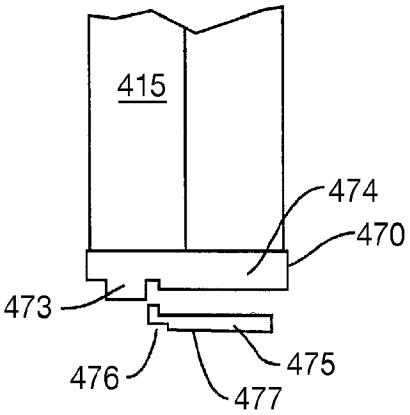
FIGS. 13C and 13D show a partial side assembly and partial front views, respectively, of a mull and mull riser used on a door sill assembly shown in FIGS. 11A and 11B.
Figure 13D:
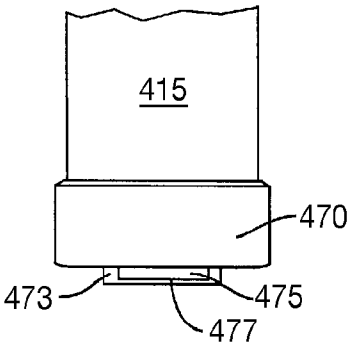
Figure 13B:
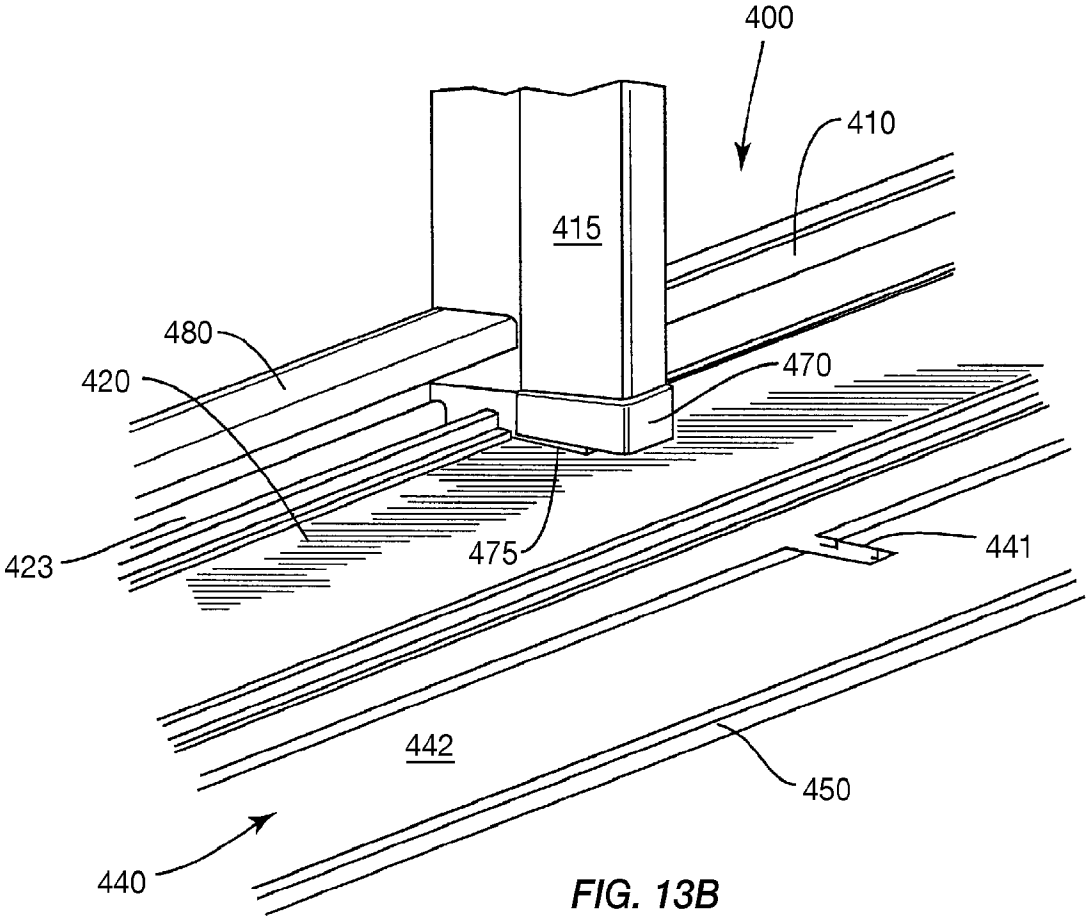

FIGS. 13A through 13B show yet another embodiment of a door sill assembly 410 with a replaceable sill deck 440 for installation in an entryway with a side light 400. Sidelight-type entryways include mullion or mull 415 engaged with the door sill assembly 410. As shown in FIG. 13A, the door sill assembly 410 includes a substrate 420, a nosing cover 460, sill channel 423 and a replaceable sill deck 440. A sill cap 480 can be used in the door sill assembly on one side of mull 415 (the sill deck 440 is removed from FIG. 13B for illustrative purposes). A sidelight cap 410 is disposed on the other side of the mull 415 in sill channel 423. The replaceable sill deck 440 can engage the nosing cover 460 and substrate 420 as described in the embodiments above and shown in FIGS. 1 through 12B, although FIG. 13A show the embodiment of FIGS. 4-5.

FIGS. 13B, 13C and 13D illustrate how the mull 415, mull boot 470 and mull riser 475 cooperate to allow the mull 415 to engage the door sill assembly 410, yet permit sill deck 440 replacement when needed. In particular, the mull boot 470 includes a sill channel engaging end 473, and a sill deck engaging end 474, each having a bottom that fits the profile of the nosing cover 460 and sill deck 440.

As shown in FIGS. 13B, 13C and 13D, a mull riser 475 can be placed on (and optionally secured) to the bottom surface of the mull boot 470. The mull riser 475 elevates the mull boot 470 above the substrate 420 so that the sill deck 442 can slide partially between the mull 415 and substrate 420 and engage the nosing cover 460 and substrate 420. The mull riser 475 includes an opening (not shown) for a mechanical fastener to be placed therethrough to secure the substrate 420, mull boot 470 and mull 415 together. As shown in FIG. 13C, the lower surface 477 of the mull riser 475 has a cut out 476 for engaging to nosing cover 460. The mull riser can be separate from the mull boot as shown. In other embodiments, the mull riser can be formed directly onto the bottom surface of the mull boot.

As shown in FIG. 13B, the deck 442 can have a notch 441 to receive the mull riser 475 as the deck 442 is placed on the substrate 420 and nosing cover 460. The notch 441 allows the deck 442 to engage the substrate 420 while allowing mull boot 470 to rest on the sill deck 440 and nosing cover 460. The door sill remains stable and the frame structure remains unaffected by removal of the sill deck 440. The installer or user may form the notch 441 on the deck 442 prior to installation. In other embodiments, the notch 441 may be formed in the deck 442 during manufacture of the sill deck 440. Further, the deck 442 can include a longitudinal score line (not shown) that provides visual indication of where the terminal end of the notch 441 should be. This score-line allows for easy construction-site modification of the deck 442 during installation of the door sill assembly.

Figure 14A:
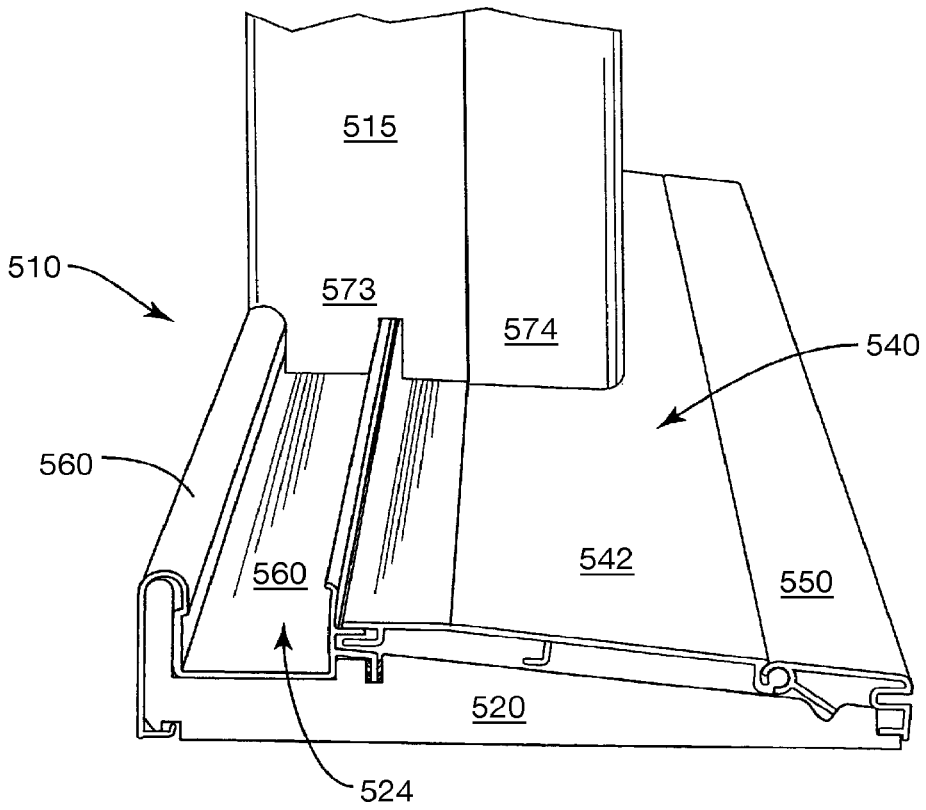
FIGS. 14A and 14B show side perspective, and front perspective assembly views, respectively, of a door sill assembly installed in an entryway having a mull and a sidelight panel according to another embodiment of the invention.
Figure 14C:
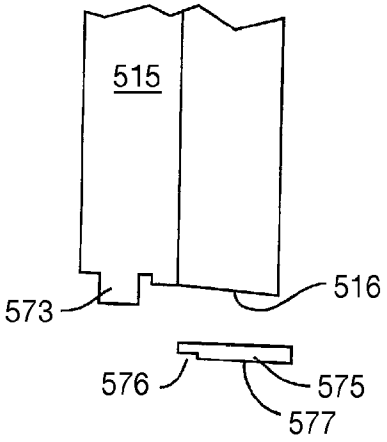
FIGS. 14C and 14D show a partial side assembly and partial front views, respectively, of a mull and mull riser used on the door sill assembly shown in FIGS. 11A and 11B.
Figure 14D:
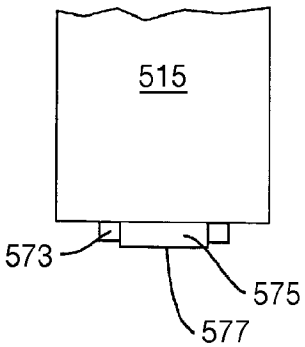
Figure 14B:
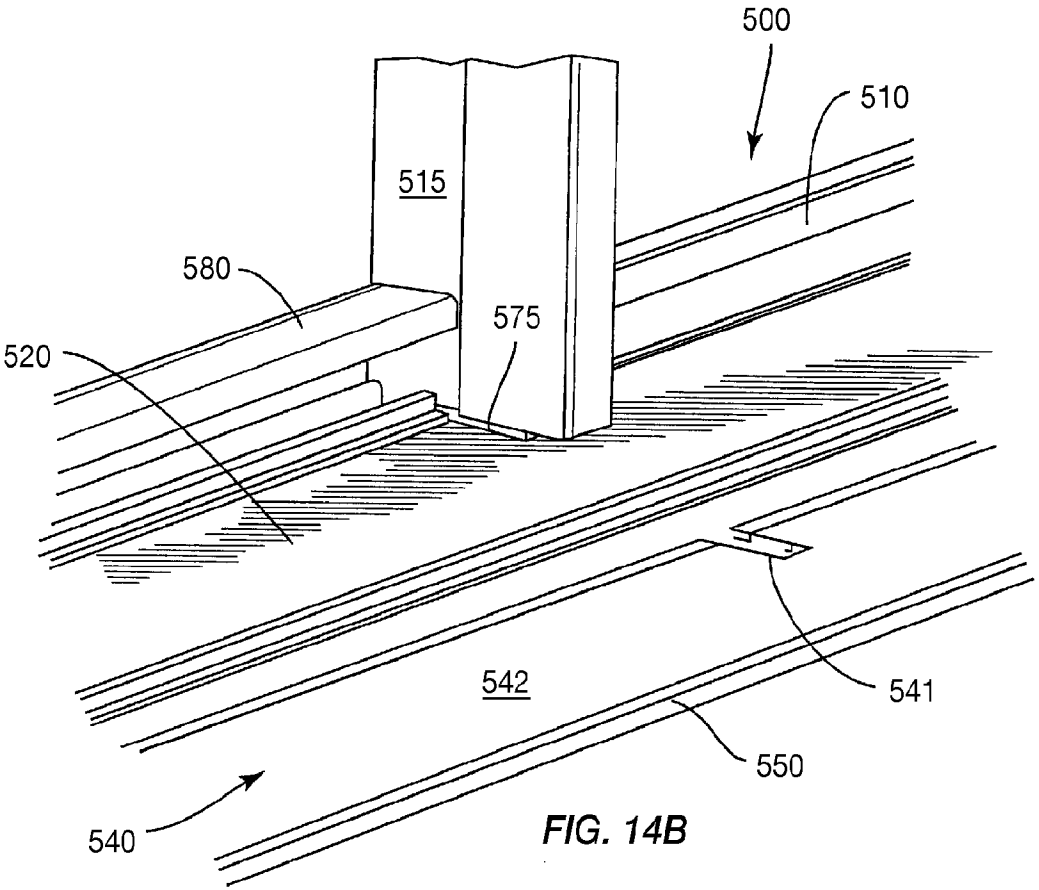

FIGS. 14A through 14C show another embodiment of a mull riser 575 for use with a mull 515 and a door sill assembly 510 installed an entryway having a sidelight 500 and sidelight cap 510. In the embodiment shown in FIGS. 14A through 14C, the mull riser 575 is secured to the bottom surface of the mull 515 and does not include a mull boot. The mull riser 575, as described above, elevates the mull 515 above the substrate 520 so that the sill deck 542 can slide between the mull 515 and the substrate 520 to engage the nosing cover 560 and sidelight cap 510. As shown in FIG. 14C, the mull riser lower surface 577 has a cut out 576 for engaging the nosing cover 560.

As described above, a notch 541 in the deck 542 receives the mull riser 575. While the mull riser 575 is shown as a separate component from the mull, in an alternate embodiment, the mull riser can be integrally formed onto the bottom surface of the mull. In addition, any of the temporary sill deck protective covers described above may include a suitable notch for receiving the mull risers.

Another embodiment of the invention is a method of using a replaceable sill deck. A door sill assembly can be provided that includes a substrate having a nosing and a sill channel. A nosing cover can be attached to the substrate and extending over at least a portion of the nosing and over at least a portion of the sill channel. A sill deck having a deck and a clip can be provided for removable attachment to the substrate and nosing cover. The deck can be placed onto and receive a portion of the nosing cover. The clip can be removably engaged with the substrate. To remove the sill deck, a tool can be used to position the clip out of engagement with the substrate and/or deck. The deck can then be removed from engagement with the nosing cover. Another sill deck can be replaced by reversing the above steps.

In another embodiment, the door sill assembly can include one or more temporary protective covers placed over a portion of the substrate engaged with the nosing cover. A first temporary protective cover can be placed on the sill channel and nosing cover. A second temporary protective cover can be placed on the substrate and engage the nosing cover or a substrate dam. The door sill assembly with one or more temporary protective covers can be installed in an entryway. When construction of the building is complete, the temporary protective covers can be removed from the door sill assembly. The replaceable sill deck having a deck and clip connected to the deck can be removeably attached to the substrate as discussed above.

The replaceable sill deck and temporary protective covers as described herein can be used with selectively positionable sill and panel caps in entryways having one or more fixed sidelight panels. Selectively positionable sill and panel caps are described in U.S. Pat. No. 5,426,894, the entirety of which is herein incorporated by reference. Entryways with fixed sidelight panels can have a continuous sidelight threshold and door sill assembly. A channel (similar to 23, 123 or 223 shown in FIGS. 2, 5, 8, and 11 respectively), nosing cover (similar to 60, 160, 260, or 360 in FIGS. 2, 5, 8, and 11 respectively), can extend the length of the continuous threshold. The sill and panel caps can have a length (in the Z-direction as shown in the Figures) that is smaller than the length of the channel. A panel cap can be selectively positioned in the channel to underlie the fixed sidelight panel. The sill cap can also be selectively positionable in a sill channel to underlie the hinged door. Both the sill cap and panel cap can engage the replaceable sill deck as described in the embodiments above and shown in FIGS. 1 through 14D.

The replaceable sill deck and temporary protective covers as described herein can be used with substrates formed of two or more substrate sections attached and interlocked together end-to-end (not shown). Such interlocking substrates are described in U.S. Pat. No. 7,350,336, the entirety of which is herein incorporated by reference. In an embodiment, the substrate can be comprised of at least first and second substrate sections. The first substrate section can have dovetail tongues on one end thereof, and dovetail grooves on the other end thereof. The dovetail tongue of the first substrate section can be received with an interlocked with the dovetail groove of second substrate section. In another embodiment, the substrate can have first substrate section having at least one protruding element along one end of the substrate section. A second substrate section can have at least one slot at one end of the second substrate section. The protruding elements of the first substrate section can slidingly engage in an end-to-end relationship with the slot of the second substrate section. The interlocking substrates can engage a nosing cover and replaceable sill deck as described in the embodiments above and shown in FIGS. 1 through 14D.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A door sill assembly for an entryway having side jambs, the door sill assembly comprising:

a substrate at least partially defining a sill channel; and a sill deck on the substrate, the sill deck comprising:

a deck connected to a clip, the deck removably overlaying at least a portion of the substrate, the clip being removably attached to the substrate, wherein the sill deck is capable of being slid away from the sill channel without damage to at least one of the jambs, or to the substrate, such that the sill deck can be removed in substantially one piece from the door sill assembly before or after the door sill assembly is installed in the entryway.

2. The door sill assembly of claim 1, wherein the clip is removably attached to the substrate in such a manner to minimize vertical and horizontal displacement of the clip.

3. The door sill assembly of claim 1, wherein the clip is pivotally connected to the deck.

4. The door sill assembly of claim 1, wherein the clip is removable from the deck.

5. The door sill assembly of claim 1, wherein the deck and the clip are one piece, further comprising a score line proximate to an area where the clip is connected to the deck.

6. The door sill assembly of claim 5, wherein the area comprises a groove.

7. The door sill assembly of claim 5, wherein the clip is pivotable about the deck at the score line.

8. The door sill assembly of claim 1, wherein the clip further is capable of receiving a tool that can be used to disengage the clip from the substrate.

9. The door sill assembly of claim 1, the sill channel is further defined by a dam spaced from a nosing, the dam having at least one projection extending therefrom.

10. The door sill assembly of claim 9, the deck having a channel for receiving the at least one projection extending from the dam.

11. The door sill assembly of claim 1, further comprising a sill cap, wherein the sill cap comprises a leg that has a flexible member at a lower end thereof, the flexible member when in contact with a dam of the sill channel forms a seal.

12. The door sill assembly of claim 1, wherein the deck has a first end and a second end, and a curved slot on the second end; and wherein the clip further comprises a first leg, the curved slot on the deck configured to receive at least a portion of the first leg on a clip so that the clip can pivot about the second end of the deck.

13. The door sill assembly of claim 12, wherein the curved slot comprises a knuckle joint for receiving a portion of the leg of the clip.

14. The door sill assembly of claim 12, wherein the substrate further comprises a lip, and wherein the clip engages with the lip to removably secure the clip to the substrate.

15. The door sill assembly of claim 1, wherein the clip is downwardly and inwardly extending to be releasably secured to the substrate.

16. The door sill assembly of claim 15, wherein the clip secures to a ledge on the substrate.

* * * * *